US007665635B2

(12) United States Patent
Ramet et al.

(10) Patent No.: US 7,665,635 B2
(45) Date of Patent: Feb. 23, 2010

(54) ASSEMBLY FOR PACKAGING AND DISPENSING LIQUID, A REFILLABLE UNIT AND METHOD OF DISPENSING LIQUID

(75) Inventors: Marc Ramet, Asnieres (FR); Daniel Crosnier, Offranville (FR)

(73) Assignee: L'Oreal, Paris (FR)

( * ) Notice: Subject to any disclaimer, the term of this patent is extended or adjusted under 35 U.S.C. 154(b) by 639 days.

(21) Appl. No.: 11/108,873

(22) Filed: Apr. 19, 2005

(65) Prior Publication Data

US 2005/0284891 A1 Dec. 29, 2005

Related U.S. Application Data

(60) Provisional application No. 60/569,246, filed on May 10, 2004.

(30) Foreign Application Priority Data

Apr. 21, 2004 (FR) ..... 04 04207

(51) Int. Cl.
*B65D 88/54* (2006.01)

(52) U.S. Cl. ..... 222/321.7; 222/130; 222/321.9; 141/2; 141/18; 141/22; 141/113

(58) Field of Classification Search ..... 222/321.7, 222/385, 321.9, 321.6, 402.16, 130, 136, 222/143; 141/25–29, 113, 381, 21–23, 2, 141/18, 391
See application file for complete search history.

(56) References Cited

U.S. PATENT DOCUMENTS 3,559,701 A * 2/1971 Wittersheim et al. ..... 141/20
3,680,605 A * 8/1972 Nigro ..... 141/20
3,718,165 A * 2/1973 Grothoff ..... 141/20
4,750,532 A 6/1988 Grothoff
4,817,829 A * 4/1989 Fuchs et al. ..... 222/259
4,988,017 A * 1/1991 Schrader et al. ..... 222/130
5,179,982 A * 1/1993 Berube et al. ..... 141/20
5,524,680 A * 6/1996 de Laforcade ..... 141/18
5,791,527 A * 8/1998 Giuffredi ..... 222/321.9
5,938,084 A * 8/1999 Fuchs et al. ..... 222/321.2
6,240,979 B1 * 6/2001 Lorscheidt ..... 141/2

(Continued)

FOREIGN PATENT DOCUMENTS

DE 37 40 823 A1 6/1988

(Continued)

*Primary Examiner*—Frederick C. Nicolas
(74) *Attorney, Agent, or Firm*—Oliff & Berridge, PLC

(57) ABSTRACT

An assembly for packaging and dispensing liquid may include a receptacle for containing a supply of liquid and a refillable unit arranged to be placed in a separable manner on the receptacle. The refillable unit may include a body and a piston that is movable relative to the body and that co-operates therewith to define a storage chamber of variable volume for containing the liquid. The storage chamber may be put into fluid communication with the receptacle to be filled therefrom when the refillable unit is placed on the receptacle. The refillable unit may also include a pump arranged to take liquid from the receptacle when the refillable unit is placed thereon, and to take liquid from the storage chamber when the refillable unit is separate from the receptacle. The pump may include a pump chamber that is distinct from the storage chamber.

33 Claims, 5 Drawing Sheets

U.S. PATENT DOCUMENTS 6,883,564 B2 * 4/2005 Risch et al. ..... 141/113

FOREIGN PATENT DOCUMENTS

FR 2 556 091 6/1985
FR 2 705 039 11/1994
FR 2 773 443 7/1999
FR 2 802 447 6/2001
FR 2 813 291 3/2002

* cited by examiner

ASSEMBLY FOR PACKAGING AND DISPENSING LIQUID, A REFILLABLE UNIT AND METHOD OF DISPENSING LIQUID

This non-provisional application claims the benefit of French Application No.04 04207 filed on Apr. 21, 2004 and U.S. Provisional Application No. 60/569,246 filed on May 10, 2004, the entire disclosures of which are incorporated by reference herein.

BACKGROUND

The present invention relates to an assembly for packaging and dispensing liquid, for example cosmetics, including care products.

As used throughout this application, the term "cosmetic" is used to designate a cosmetic product as defined in the Jun. 14, 1993 Directive 93/35/EEC amending Directive 76/768/EEC.

Patent application FR 2 773 443 discloses a refillable atomizer spray comprising a body that defines a chamber for storing liquid. The atomizer further comprises a piston slidably received in the body and capable of being pressed down to reduce the volume of the chamber and dispense the liquid. The quantity of substance that is dispensed depends on the length of the depression stroke of the piston with the chamber being completely emptied when the piston is depressed over its full stroke. Such an atomizer does not facilitate dispensing an accurate quantity of liquid corresponding to a fraction of the maximum volume of the chamber.

Patent application FR 2 705 039 describes a dispenser device comprising a receptacle that contains a supply of liquid and is fitted with a first pump, and a refillable flask fitted with a second pump. The flask can be refilled with liquid via the first pump. To dispense the liquid contained in the flask, the user separates the flask from the receptacle and then actuates the second pump.

Patent application FR 2 813 291 describes a system for filling a secondary flask from a main flask. The main flask is fitted with tubes enabling the main and secondary flasks to be put into fluid communication. When the secondary flask is fitted with a pump, the pump must be removed before interconnecting the main and secondary flasks for refilling.

Patent application FR 2 802 447 describes a refillable spray system comprising a tank and a spray fitted with a pump. The tank and the spray are provided with ducts suitable for being temporarily interconnected to enable the spray to be refilled. The duct extending into the spray is open at a top end thereof to allow the liquid to flow directly into the tank of the spray system.

Patent application FR 2 556 091 describes a removable refillable device comprising a body and a piston slidably received in the body. That device does not include a pump.

SUMMARY

Exemplary embodiment of the present invention seek to provide a packaging and dispensing assembly which has a structure that is relatively simple and which enables liquid to be dispensed in relatively precise manner.

Exemplary embodiment of the present invention thus may provide an assembly for packaging and dispensing liquid, the assembly comprising: a receptacle for containing a supply of a liquid; and a refillable unit arranged to be placed in a separable manner on the receptacle. The refillable unit may comprise: a body and a piston that is movable relative to the body and that co-operates therewith to define a storage chamber of variable volume for containing the liquid, and a pump arranged to take liquid from the receptacle when the refillable unit is placed thereon, and to take liquid from the storage chamber when the refillable unit is separate from the receptacle. The storage chamber may be put into fluid communication with the receptacle to be filled therefrom when the refillable unit is placed on the receptacle. The pump may include a pump chamber that is distinct from the storage chamber, that is, that does not coincide therewith. The storage chamber may be formed under the piston when the refillable unit is observed in a head-up position.

In exemplary embodiments, when the refillable unit is used separately from the receptacle, one or more measured quantities of liquid may be dispensed relatively accurately, each quantity corresponding to a fraction only of a maximum volume of the storage chamber. The quantity dispensed may be determined by a maximum volume of the pump chamber, where the maximum volume of the pump chamber is smaller than the maximum volume of the storage chamber.

In exemplary embodiments, the pump may also be used to take liquid from the supply of liquid in the receptacle.

In embodiments in which the receptacle includes an outlet orifice arranged to be put into fluid communication with the storage chamber of a refillable unit for refilling purposes, the receptacle need not include have a pump that feeds the outlet orifice with liquid. The structure of the receptacle may thus be relatively simple.

Thus, exemplary embodiments of the invention may include only one pump, that of the refillable unit, thus enabling costs to be reduced.

Advantageously, the refillable unit may be arranged to enable suction to be generated in the storage chamber, at least when the storage chamber is in fluid communication with the receptacle, so as to enable the storage chamber to be filled.

In exemplary embodiments, the pump chamber may be isolated from the storage chamber, at least while the liquid is being dispensed by the pump.

In exemplary embodiments, the pump may include a suction orifice that is disposed close to an outlet orifice of the receptacle, for example, vertically in registration with the outlet orifice, when the refillable unit is placed on the receptacle.

Thus, in such embodiments, the liquid leaving the receptacle via the outlet orifice may flow toward the suction orifice of the pump following a path that is relatively short, thereby limiting head losses.

In exemplary embodiments, the pump may comprise an "airless" pump, that is, a pump without any air intake. The pump may be with or without precompression.

In exemplary embodiments, the receptacle may include a support arranged to receive the refillable unit. The support may be held stationary relative to a remainder of the receptacle, for example. The support may be constituted by a separate part or may be made monolithically with the receptacle.

In exemplary embodiments, the refillable unit and the receptacle may include respective fastener portions that co-operate in a releasable manner, for example, by snap-fastening, screw-fastening, bayonet-type fastening, by friction, or in some other way. This allows the refillable unit to be secured to the receptacle while the storage chamber is being filled and/or while the pump of the refillable unit is being used to take liquid from the receptacle.

Advantageously, at least one of the refillable units and the receptacle may include portions in relief that co-operate with the other of the refillable unit and the receptacle to isolate a suction orifice of the pump in a leakproof or leaktight manner from outside, at least when the refillable unit is used to take liquid from the receptacle.

In exemplary embodiments, the receptacle may include an air intake passage that allows air to be taken in when the pump of the refillable unit is used to take the liquid from the receptacle.

In other exemplary embodiments, the receptacle does not include an air intake. In such embodiments, the receptacle may include, for example, a piston or a bag in contact with the liquid. For example, the receptacle may have a piston that moves in response to liquid being extracted from the receptacle. For example, the liquid may alternatively be contained in a flexible bag.

In exemplary embodiments, when the refillable unit is placed on the receptacle so that the pump may take liquid therefrom, a volume of the storage chamber may preferably be at a minimum, for example being substantially zero. In such embodiments, the pump may communicate with a dip tube of the receptacle, for example.

In exemplary embodiments, the piston may include an orifice that puts the receptacle into fluid communication with the storage chamber.

In exemplary embodiments, the piston may advantageously have a shape that substantially matches an outside shape of the pump. This may make it possible to reduce a quantity of liquid remaining in the refillable unit when the volume of the storage chamber is at its minimum.

In exemplary embodiments, the refillable unit may include a check valve disposed in the orifice of the piston. The check valve may be movable between a first position in which the check valve closes the orifice of the piston, and a second position in which the check valve allows liquid to flow through the orifice. The check valve may comprises a body with an inside passage.

In exemplary embodiments, the check valve may comprise a ball. In such embodiments, the refillable unit may include a resilient return member arranged to apply a force on the ball, tending to return the ball into the closed first position.

In exemplary embodiments, the piston may include a fastener portion that co-operates in a releasable manner, for example, by screw-fastening or snap-fastening, with a fastener portion of the receptacle when the refillable unit is placed on the receptacle.

In exemplary embodiments, the piston may include a skirt defining a passage in communication with an orifice of the piston. The skirt may include the fastener portion, for example.

In exemplary embodiments, the piston may include substantially coaxial inner and outer skirts. In such embodiments, the fastener portion may be provided on the outer skirt, and the inner skirt may define, for example, a passage in communication with an orifice of the piston.

In exemplary embodiments, the receptacle may include a central portion that engages in the body of the refillable unit when said refillable unit is placed on the receptacle. In such embodiments, the central portion may include a fastener portion that co-operates with a fastener portion of the piston. The central portion may serve to fasten a dip tube, for example.

In exemplary embodiments, the receptacle may contain a liquid comprising a cosmetic or a care product. For example, the receptacle may contain a perfume. The liquid may also comprise a cream, for example.

Exemplary embodiments of the invention may also provide a refillable unit arranged to be placed in a separable manner on a receptacle. The refillable unit may comprise a body and a piston that is movable relative to the body and that co-operates therewith to define a storage chamber of variable volume for containing the liquid, and a pump arranged to take liquid from the receptacle when the refillable unit is placed on the receptacle, and to take liquid from the storage chamber when the refillable unit is separate from the receptacle. The storage chamber may be put into fluid communication with the receptacle to be filled therefrom when the refillable unit is placed on the receptacle. The pump may include a pump chamber that is distinct from the storage chamber. The storage chamber may be formed under the piston when the refillable unit is observed in a head-up position.

In exemplary embodiments, the refillable unit may be arranged to enable suction to be generated in the storage chamber, at least when the storage chamber is in fluid communication with the receptacle, so as to enable the storage chamber to be filled under an effect of the suction.

In exemplary embodiments, the volume of the pump chamber may be preferably smaller than the maximum volume of the storage chamber.

In exemplary embodiments, the piston may include an orifice that puts the receptacle into fluid communication with the storage chamber.

Exemplary embodiments of the invention may also provide a method of dispensing liquid, comprising: providing a packaging and dispenser assembly including a receptacle for containing a supply of liquid, and a refillable unit as described above; using the refillable unit to take one of liquid from the receptacle when the refillable unit is placed on the receptacle, and liquid from the storage chamber of the refillable unit when the refillable unit is separate from the receptacle; and dispensing a quantity of liquid taken by the refillable unit by actuating the pump over a full stroke. The quantity of liquid dispensed may correspond to a fraction only of a maximum volume of the storage chamber. For example, the fraction may be less than one-tenth thereof.

In exemplary embodiments in which the pump includes a suction orifice and the receptacle includes an outlet orifice, the method may further comprise: putting the suction orifice into communication with the outlet orifice; and taking liquid from the receptacle.

In exemplary embodiments in which the refillable unit includes a body and a piston sliding in the body, the method may further comprise: placing the refillable unit on the receptacle; and moving the piston relative to the body in order to increase the volume of the storage chamber, the piston moving away from the pump during this movement.

BRIEF DESCRIPTION OF THE DRAWINGS

The present invention may be better understood on reading the following detailed description of non-limiting embodiments thereof, and on examining the accompanying drawings, in which.

DETAILED DESCRIPTION OF EMBODIMENTS

Figure 1:
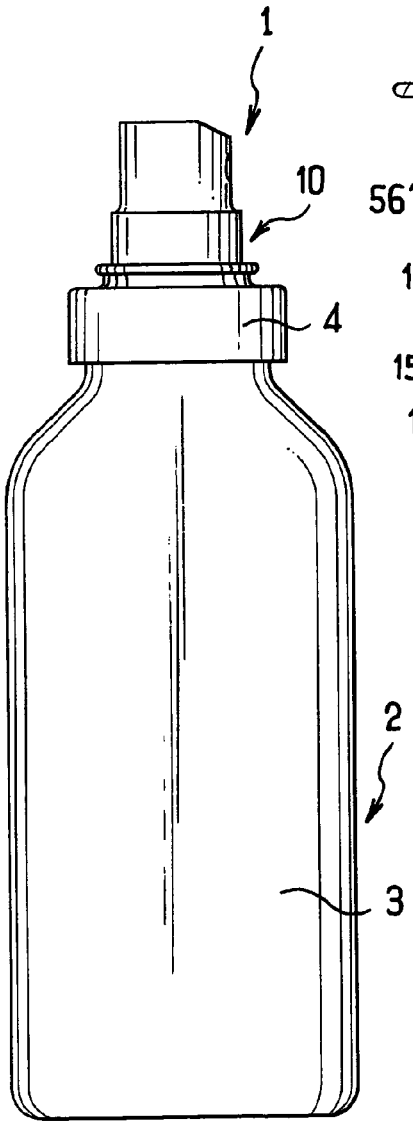
FIG. 1 is a diagrammatic and fragmentary view of an exemplary packaging and dispenser assembly.

FIG. 1 shows an exemplary packaging and dispenser assembly 1.

The assembly 1 may comprise a receptacle 2 including a receptacle body 3 and a support 4 secured on the body 3.

The receptacle 2 may contain a supply of liquid.

In the exemplary embodiment, the liquid may be a cosmetic, for example a perfume or some other low-viscosity liquid, for example, containing an alcohol-based solvent.

In exemplary embodiments, the liquid may be a cream, for example, a care product, a lotion, or some other liquid for applying to a portion of the body or the face, including the hair.

The support 4 may comprise: an assembly skirt 5 that enables the receptacle body 3 to be screw-fastened on the neck 6; a substantially cylindrical wall 8 of axis X forming a housing 9 for receiving a refillable unit 10; and a central portion 15 extending inside the housing 9. The wall 8 may have a cross-section that may be circular, elliptical, or some other shape.

In the exemplary embodiment, the assembly skirt 5 may be screw-fastened on the neck 6. However, in other exemplary embodiments, the assembly skirt 5 may be secured in some other way, for example, by snap-fastening or crimping.

Where appropriate or desired, at least one of the neck 6 and the support 4 may include antirotation means, for example, a portion in relief (not shown) that prevents the support 4 from turning relative to the receptacle 2.

The support 4 may be pressed against the neck 6 to prevent liquid escaping, while also leaving an air intake passage between the inside of the receptacle 2 and the outside.

In other exemplary embodiments, the receptacle need not include an air intake between the inside and the outside.

The wall 8 may have a cross-section that may be circular, elliptical, or some other shape.

The central portion 15 may comprise a tubular wall 16 of axis X that may be slightly frustoconical, tapering upward, and that may be connected at a bottom end thereof to the wall 8 via a bottom wall 17.

In other exemplary embodiments, the wall 16 may have some other shape.

A dip tube 99 may be secured in an inside space defined by the tubular wall 16. The dip tube 99 may opens at a top end thereof to an outlet orifice 19 formed on the central portion 15.

Above the outlet orifice 19, the top end of the central portion 15 may comprise a fastener portion 20 which, in the exemplary embodiment, may be provided with an annular bead 21, the purpose of which is described below.

Between the fastener portion 20 and the orifice 19, the central portion may include an internal annular groove 22.

The refillable unit 10 may include a body 25 that may comprise a cylindrical wall 26 of axis X and a bottom wall 27. The bottom wall 27 may be provided with an opening 28 that enables the central portion 15 to be inserted through said opening 28 when the refillable unit 10 is inserted in the housing 9 of the receptacle.

At a bottom portion thereof, the body 25 may be provided with splines 30 that are parallel to the axis X and are designed to serve as abutments, as described further below.

The refillable unit 10 may include a piston 32 that presses against an inside surface of the body 25 via bottom and top annular lips 33 and 34.

Together with the body 25, the piston 32 may form a storage chamber 55 of variable volume above the piston 32. The piston 32 may include a skirt 35 that extends beneath the lips 33 and 34. The skirt 35 may define a passage 36 that puts a space situated above the piston 32 into communication with a space situated beneath the piston 32.

At a top portion thereof, the skirt 35 may include an inner annular bead 37, and at a bottom portion thereof, may include an orifice 38 in which a check valve 39 is engaged.

In the exemplary embodiment, the bottom of the skirt 35 may be connected to a fastener portion 42 including an annular groove 48 in which the annular bead 21 of the receptacle 2 may be engaged, for example, by snap-fastening.

The check valve 39 may comprise a hollow body that defines an inside passage 45 of axis X. The passage may open at a top portion thereof to the outside via lateral openings 47.

On an outside surface thereof, the check valve 39 may include an annular bead 46 that snap-fastens in the groove 22 of the receptacle 2, so as to provide a leaktight bearing between the check valve 39 and the central portion 15 of the receptacle 2, and fastening therebetween.

Additional annular beads 51 may be provided on the outside surface of the check valve 39 above the annular bead 46, so as to come to press with a certain friction force against the inside surface of the skirt 35 when the check valve 39 is moved upward in the orifice 38, so as to limit movement of the check valve 39 when the refillable unit 10 is in place on the receptacle 2.

The beads 51 may also enable the check valve 39 to be maintained in the closed position when the refillable unit 10 is used separately from the receptacle 2, for example, to ensure that the refillable unit 10 is leaktight.

Figure 3:
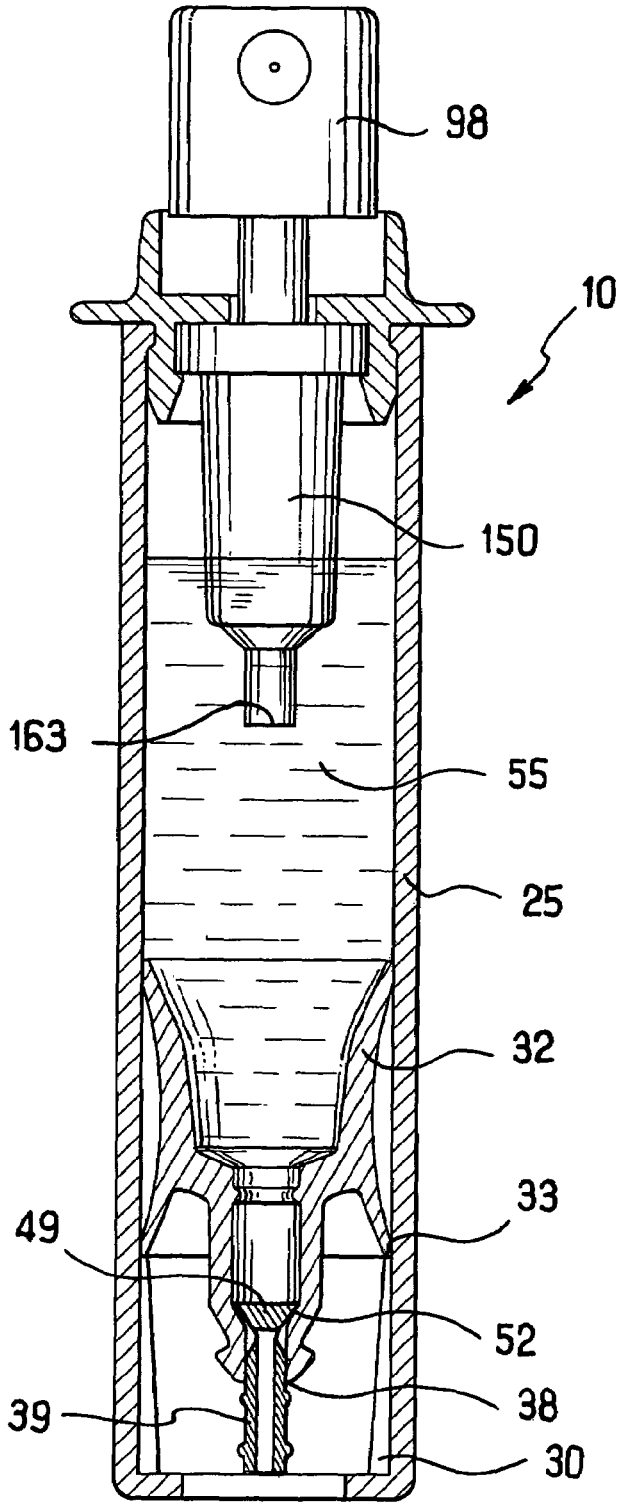
FIG. 3 is a diagrammatic and fragmentary axial section view of the releasable unit of the assembly of FIG. 2, separated from the receptacle.

The check valve 39 may be provided with a frustoconical top portion 49 that presses against a frustoconical surface 52 of the skirt 35, so as to close the orifice 38 of the piston 5, when the refillable unit 10 is separated from the receptacle 2, as shown in FIG. 3.

The refillable unit 10 may include a top wall 54 with an assembly skirt 56 secured in the body 25.

The skirt 56 may also serve to hold an airless pump 150 including a pump chamber 157.

The pump 150 may include a duct 162 that is relatively short compared to a height of the body 25. A bottom end of the duct 162 may include a suction orifice 163.

Figure 4:
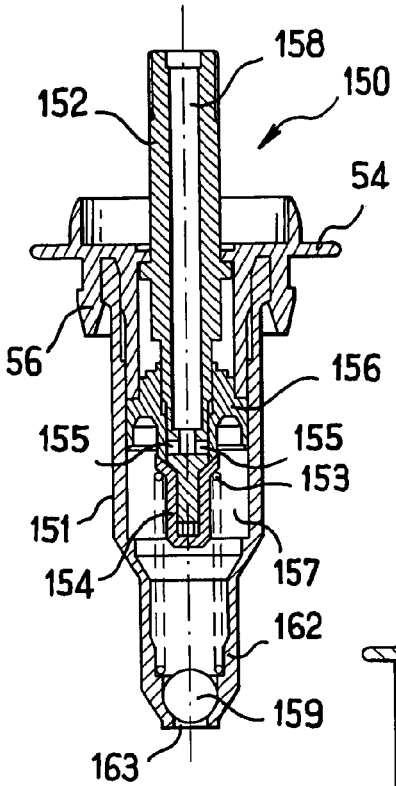
FIG. 4 is a diagrammatic and fragmentary axial section view of the pump of the refillable unit of the assembly of FIGS. 2 and 3.

As shown in FIG. 4, for example, the pump 150 may include a body 151 secured on the skirt 56, for example, by snap-fastening.

A control rod 152 may be mounted in the body 151 to slide against action of a return spring 153 working in compression. An endpiece 154 may be secured to a bottom end of the control rod 152.

Figure 2:
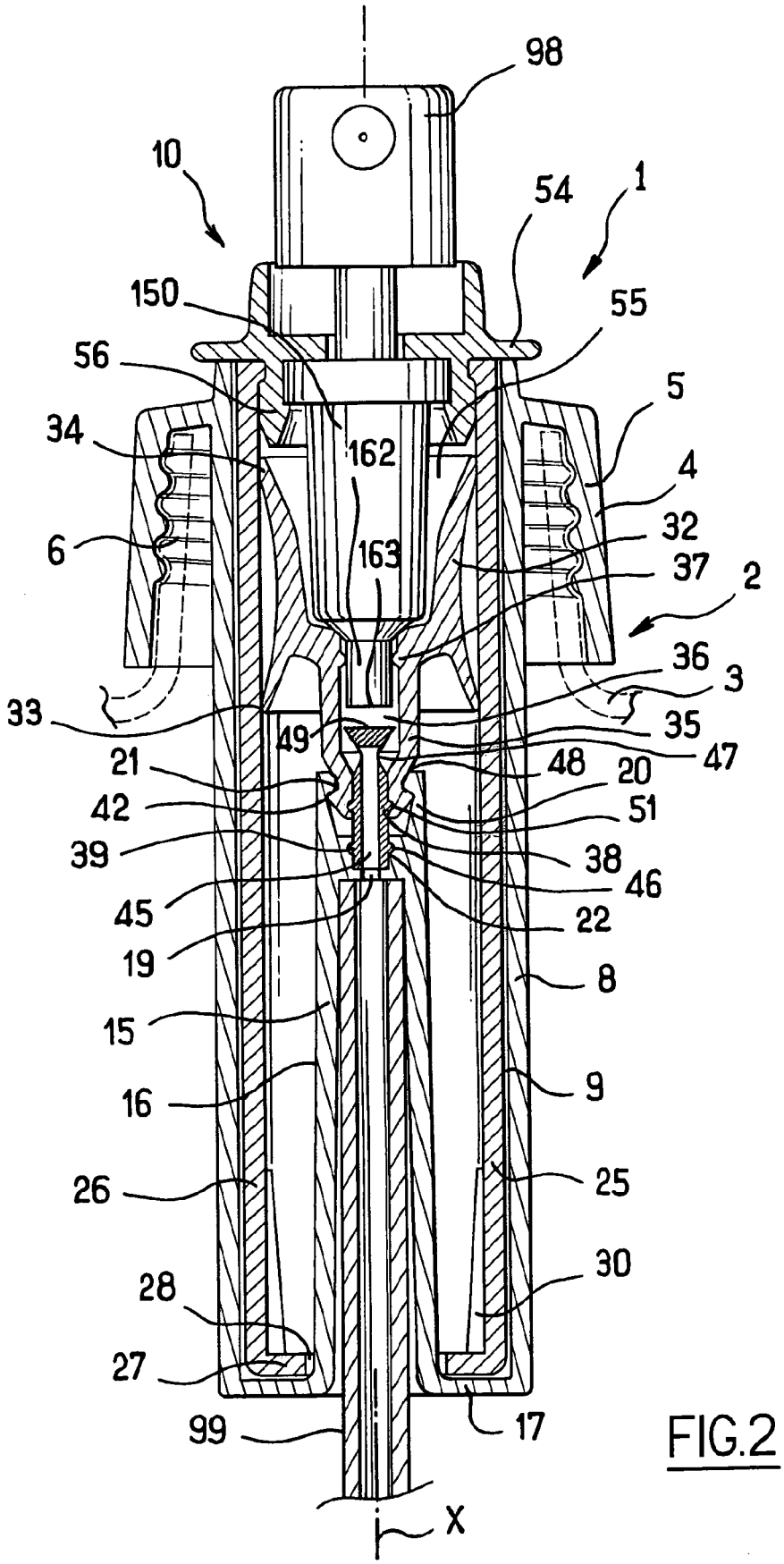
FIG. 2 is a diagrammatic and fragmentary axial section view of the assembly of FIG. 1.

A pushbutton 98 that serves both as an actuator member and as a dispenser member may be engaged as a force-fit on a top end of the control rod 152, for example, as shown in FIG. 2.

The control rod 152 may include an axial bore 158 that extends to a top end thereof and opens into the pump chamber 157 via radial orifices 155.

A piston 156 may be disposed to slide around the rod 152. The piston 156 may co-operate with the body 151 to define the pump chamber 157.

The body 151 may form a seat for a ball 159 that, at rest, closes the orifice 163.

When the control rod 152 is at rest, the orifices 155 may be closed by the piston 156.

When a user presses on the pushbutton 98, the control rod 152 may be depressed into the body 151. At the beginning of its depression stroke, the piston 156 may not be driven by the control rod 152. The control rod may thus move relative to the piston 156, thereby releasing the orifices 155. As the depression stroke of the control rod 152 continues, the control rod 152 may entrain the piston 156 downward. Liquid in the pump chamber 157 may then be compressed and may flow into the bore 158 via the orifices 155 to be dispensed.

While the control rod 152 is moving downward, the ball 159 may remain pressed against its seat in a bottom of the body 151, thereby isolating the pump chamber 157 from the storage chamber 55.

When the user releases the pushbutton 98, the control rod 152 may begin by sliding in the piston 156 until coming into top abutment against the endpiece 154.

The axial bore 158 may then be isolated from the pump chamber 157 and continued upward movement of the control rod 152 under drive from the spring 153 may generate suction in the pump chamber 157, which may be accompanied by the ball 159 lifting and liquid being sucked into the pump chamber 157.

The pump 150 may comprise some other structure without thereby going beyond the ambit of the present invention. For example, the ball 159 may be replaced by a suction check valve made of elastomer, for example.

The piston 32 may have a shape that substantially matches an outside shape of the pump 150, so that the volume of the storage chamber and the passage 36 is as small as possible when the piston 32 is completely raised.

The orifice 163 may be situated remote from a top wall of the storage chamber 55, so as to be immersed in liquid even when a layer of air is above the liquid in a top portion of the storage chamber 55.

In the exemplary embodiment, the skirt 35 may surround the duct 162 of the pump with a small amount of clearance, and the bead 37 may press against the pump 150 in a leaktight manner, for example.

The assembly 1 may be used in various ways.

For the purpose of taking and dispensing liquid contained in the receptacle 2, the user may place the refillable unit 10 on the receptacle 2 so that the fastener portion 42 of the piston 32 becomes engaged on the fastener portion 21 of the central portion 15 of the receptacle 2, for example, as shown in FIG. 2.

The closure member 39 may be moved upward so as to free the lateral openings 47, thereby enabling the inside passage 45 to communicate firstly with the passage 36 of the skirt 35, and secondly with the outlet orifice 19 of the receptacle 2.

When the refillable unit 10 is secured on the receptacle 2, the volume of the storage chamber 55 is at its minimum, the piston 32 being pushed until pressing against the pump 150, the annular bead 37 presses in a leaktight manner against the duct 162 of the pump 150, for example, as shown in FIG. 2.

By pressing on the pushbutton 98, the user may cause liquid contained in the pump chamber of the pump 150 to be dispensed.

By releasing the pushbutton 98, the pump 150 may suck in liquid contained in the receptacle 2, the liquid flowing along a path passing via the dip tube 99, the outlet orifice 19, the inside passage 45 of the check valve, and the passage 36 of the skirt 35.

Additional pressure on the pushbutton 98 may enable the liquid sucked in this manner to be dispensed.

To fill the storage chamber 55, the user may move the body 25 of the refillable unit upward relative to the receptacle 2, with the piston 32 remaining secured to the fastener portion 20 of the receptacle 2.

Thus, the piston 32 may slide downward relative to the body 25, thereby generating suction in the storage chamber 55 that enables liquid contained in the receptacle 2 to be sucked in via the inside passage 45 of the closure member 39.

At an end of stroke, the bottom lip 33 of the piston 32 may press via a relatively stiff portion against the splines 30, so that when the user continues to move the refillable unit 10 upward: the skirt 35 may be released from the central portion 15, with the check valve 39 remaining secured to the central portion 15; then, the frustoconical portion 49 may press against the corresponding frustoconical surface 52 of the skirt 35, so as to close the orifice 38; and then, the check valve 39 may be released from the central portion 15.

Such a sequence helps to ensure that the check valve 39 is in the closed position when the refillable unit 10 is removed.

When the refillable unit 10 is separated from the receptacle 2, the user may dispense the liquid contained in the storage chamber 55 by actuating the pump 150.

The piston 32 may rise in the body 25 as the storage chamber 55 empties.

When the refillable unit 10 is partially full of liquid, putting the refillable unit 10 in place on the receptacle 2 may cause liquid that was contained in the storage chamber 55 to be expelled into the receptacle 2, with the check valve 39 passing into the open position before the piston 32 becomes fastened on the central portion 15.

The invention is not limited to the exemplary embodiments described above.

Figure 5:
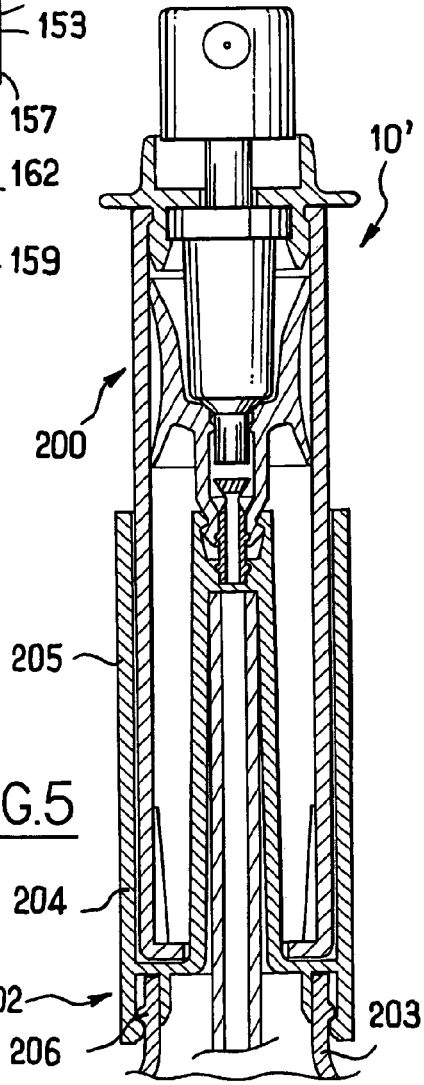
FIG. 5 is a diagrammatic and fragmentary axial section view of another exemplary packaging and dispenser assembly.

FIG. 5 shows an exemplary packaging and dispenser assembly 200 in accordance with another embodiment of the invention.

The assembly 200 may include a refillable unit 10' that is substantially similar to the refillable unit described above.

The refillable unit 10' may have a height that is shorter, and a cross-section that is greater than the refillable unit 10.

The refillable unit 10' may be refilled by a receptacle 202 comprising a receptacle body 203 with a neck 206 on which a support 204 is secured, for example, by snap-fastening.

For example, the support may comprise a tubular skirt 205 of axis X that extends above the neck 206 of the receptacle body 203 to receive the refillable unit 10'.

Figure 6:
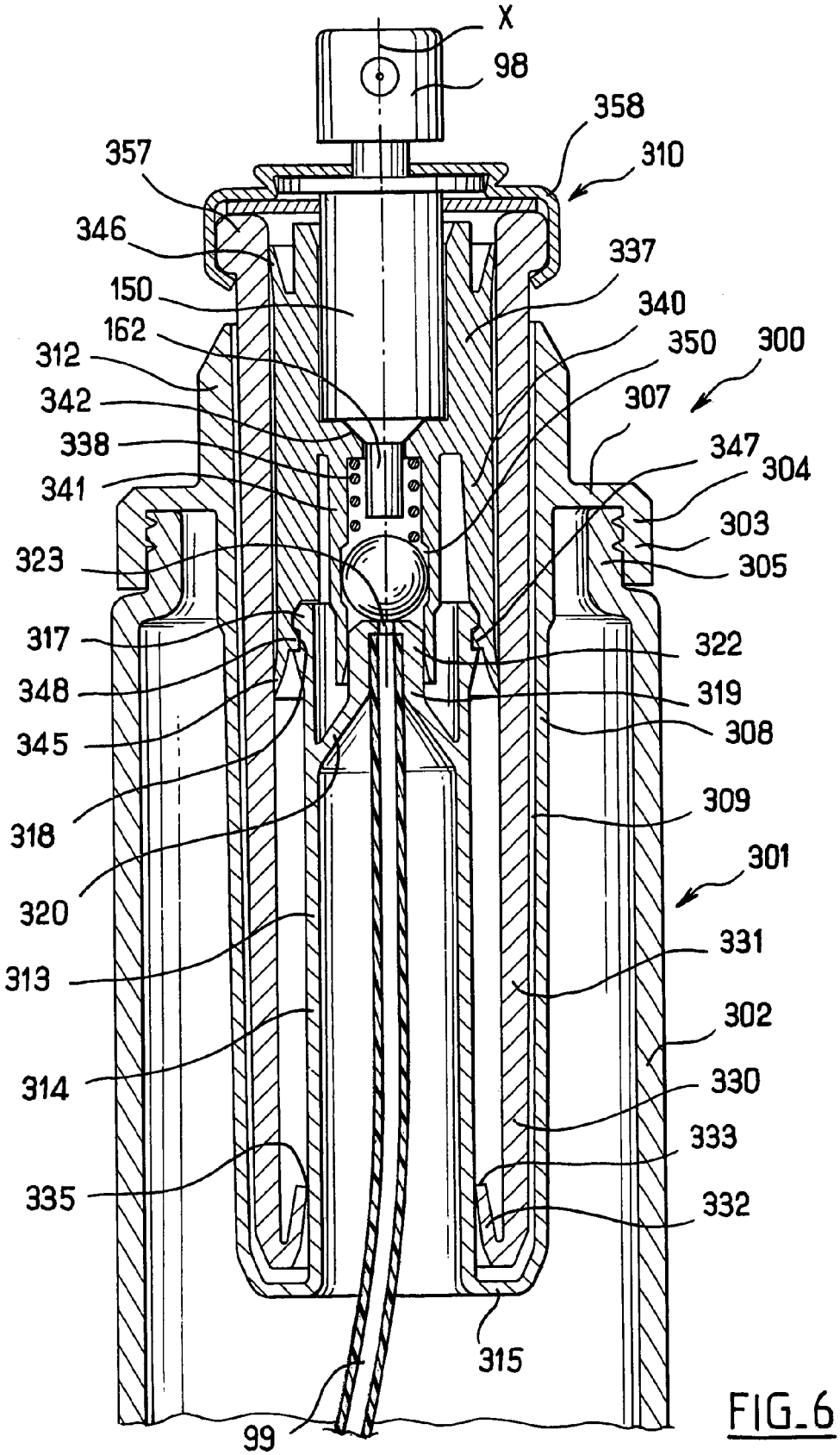
FIGS. 6 and 7 are diagrammatic and fragmentary axial section views of another exemplary packaging assembly in two different positions.
Figure 7:
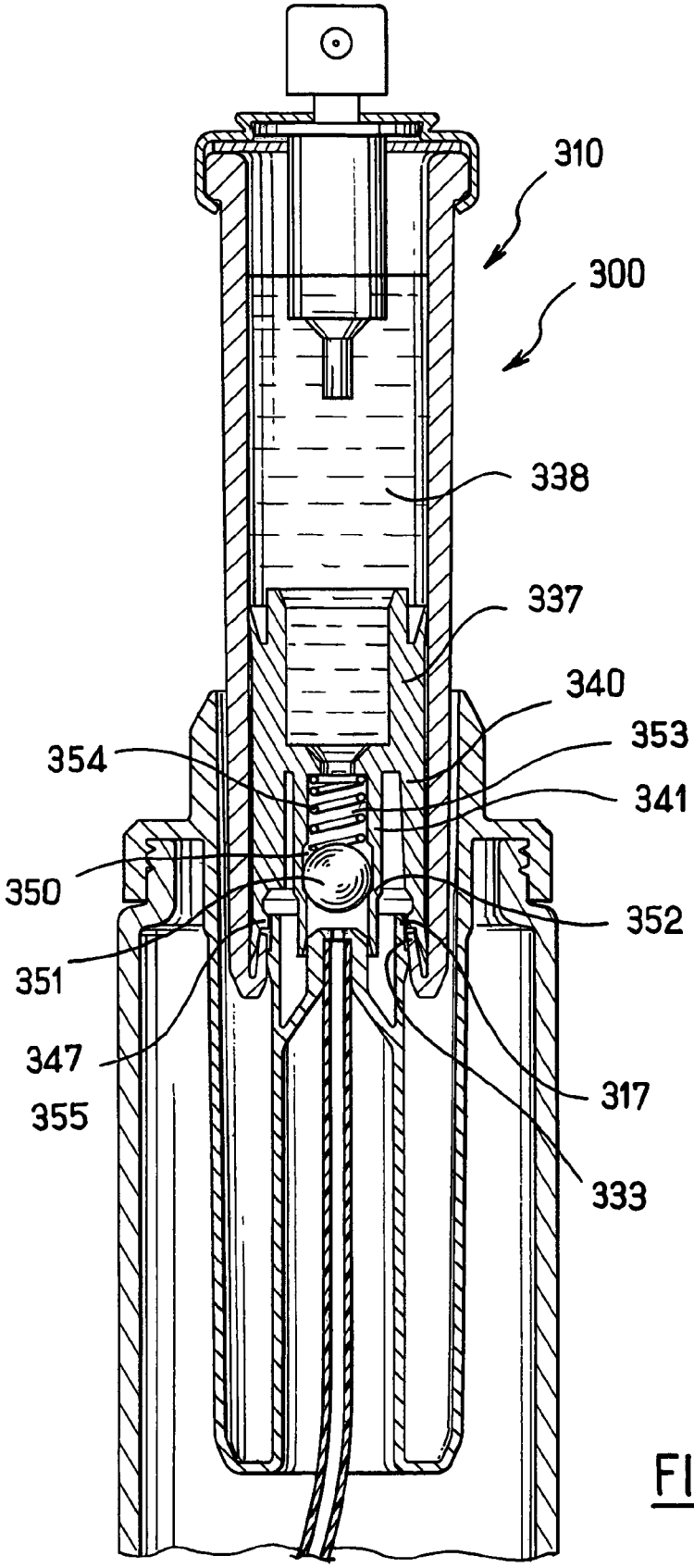

FIGS. 6 and 7 show an exemplary packaging assembly 300 in accordance with another embodiment of the invention.

The assembly 300 may include a receptacle 301 comprising a receptacle body 302 and a support 303 secured to the body 302.

The support 303 may comprise: an assembly skirt 304 that enables the receptacle body 302 to be screwed onto a neck 305; a transverse wall 307 that presses against the top segment of the neck 305; and a substantially cylindrical wall 308 of axis X that forms a housing 309 for receiving a refillable unit 310.

A major fraction of the wall 308 may extend beneath the transverse wall 307 when the assembly 300 is observed head-up, with the wall 308 forming a cylindrical portion 312 above the transverse wall 307.

The support 303 may further comprise a central portion 313 that extends into the housing 309 and comprises a substantially cylindrical wall 314 of axis X connected at a bottom end thereof to the wall 308 via a bottom wall 315.

At a top end thereof, the wall 314 may include a fastener portion 317 provided with a groove 318, the purpose of which is described below.

The central portion 313 may include an endpiece 319 that extends into an inside space defined by the wall 314, with the endpiece 319 comprising a frustoconical wall 320 that is connected to the wall 314 beneath the fastener portion 317.

The frustoconical wall 320 may be extended by a cylindrical portion 322 of axis X that communicates at a top end thereof with an outlet orifice 323.

A dip tube 99 may be secured in the inside space defined by the portion 322, with the dip tube 99 opening at a top end thereof to the outlet orifice 323.

The refillable unit 310 may include a body 330 comprising a tubular wall 331 of axis X with a return margin 332 at a bottom end thereof.

The margin 332 may have an upwardly-tapering, slightly frustoconical shape with an annular edge 333, and may have an inside diameter that is slightly smaller that the maximum diameter of the fastener portion 317.

The rim 333 may define an opening 335 that enables the central portion 313 to be inserted through the opening 335 when the refillable unit 310 is inserted into the housing 309 of the receptacle 301.

The refillable unit 310 may include a piston 337 which may co-operate with the body 330 to form a storage chamber 338 of variable volume above the piston 337.

The piston 337 may include outer and inner coaxial skirts 340, 341, with the inner skirt 341 being connected to the inside surface of the outer skirt 342 substantially mid-way up the outer skirt, forming an opening 342 of substantially frustoconical shape that tapers downward.

The piston 337 may include bottom and top annular lips 345, 346 connected to the outer skirt 340 and pressed against the inside surface of the body 330.

The outer skirt 340 may include a fastener portion 347 that includes an annular bead 348 arranged to become engaged by snap-fastening in the groove 318 of the fastener portion 317 of the receptacle 301 when the refillable unit 310 is inserted into the housing 309 of the receptacle.

The inner skirt 341 may form a housing 350 arranged to receive a check valve, for example, comprising a ball 351. The housing 350 may include a bearing surface 352 against which the ball 351 may be pressed to close a passage 353 defined by the inner skirt 341.

The refillable unit 310 may include a resilient return member 354 arranged to exert a force on the ball 351, such force tending to press the ball 351 against the bearing surface 352 so as to close the passage 353.

In the exemplary embodiment, the resilient return member 354 may comprise a helical spring that, at one end, presses against the ball 351, and at an opposite end, presses against the piston 337.

The annular bearing surface 352 may define an orifice 355 that may be put into fluid communication with the outlet orifice 323 of the receptacle.

At a top end thereof, the body 330 may include a bead 357 that enables a pump 150 to be put in place by a fret 358.

The pump 150 may include a duct 162 that is arranged to engage in the passage 353 of the piston 337 via the opening 342.

The piston 337 may have a shape that substantially matches an outside shape of the pump 150.

The assembly 300 may be used in various ways.

For the purpose of taking and dispensing the liquid contained in the receptacle 301, the user may place the refillable unit 310 on the receptacle 301 so that the fastener portion 347 of the refillable unit 310 becomes engaged on the fastener portion 317 of the receptacle by inserting the bead 348 in the groove 318, for example, as shown in FIG. 6.

The inner skirt 341 of the piston 337 may be pressed in a leaktight manner against the endpiece 319 of the receptacle.

The ball 351 may be displaced by pressing upward against the endpiece 319, against the force exerted by the spring 354, so as to move away from the bearing surface 352 and open the orifice 355.

When the refillable unit 310 is secured on the receptacle 301, the volume of the storage chamber 338 may be at its minimum, with the piston 337 being pushed until coming to press against the pump 150.

The pump 150 may be pressed in a leaktight manner against the piston 337.

By pressing on the pushbutton 98, the user may cause liquid contained in the pump chamber of the pump 150 to be dispensed.

By releasing the pushbutton 98, the pump 150 may suck in liquid contained in the receptacle 301, the liquid flowing along a path passing via the dip tube 99, the outlet orifice 323, and the passage 353 of the skirt 341.

To fill the storage chamber 338, the user may move the body 330 of the refillable unit upward relative to the receptacle 301, with the piston 337 remaining secured to the fastener portion 317 of the receptacle.

Thus, the piston 337 may slide relative to the body 330, thereby generating suction in the storage chamber 338 that enables liquid contained in the receptacle to be sucked in via the orifice 323 of the receptacle and the passage 353 of the piston 337.

At the end of the stroke, the annular edge 333 of the body 330 may be pressed against the fastener portion 317 of the receptacle and the fastener portion 347 of the piston 337 so as to contribute to releasing the annular bead 348 from the groove 318 of the receptacle by elastic deformation.

When the refillable unit 310 is removed from the receptacle, the spring 354 may return the ball 351 against the bearing surface 352 so as to close the orifice 355, for example, as shown in FIG. 7.

The user may dispense the liquid contained in the storage chamber 358 by actuating the pump 150.

The piston 337 may rise in the body 330 as the storage chamber 338 empties.

Throughout the description, including in the claims, the term "comprising a" should be understood as being synonymous with "comprising at least one" unless specified to the contrary.

Although the present invention herein is described with reference to particular exemplary embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An assembly for packaging and dispensing liquid, the assembly comprising:

a receptacle for containing a supply of a liquid; and a refillable unit arranged to be placed in a separable manner on the receptacle, the refillable unit comprising:

a body and a piston that is movable relative to the body and that co-operates therewith to define a storage chamber of variable volume for containing the liquid, the storage chamber being put into fluid communication with the receptacle to be filled therefrom when the refillable unit is placed on the receptacle; and a pump arranged to take the liquid from the receptacle without taking the liquid from the storage chamber when the refillable unit is placed thereon, and to take the liquid from the storage chamber when the refillable unit is separate from the receptacle, the pump including a pump chamber that is distinct from the storage chamber, wherein the storage chamber is formed above the piston when the refillable unit is observed in a head-up position and the pump chamber is isolated from the storage chamber, at least while the pump is dispensing the liquid.

2. An assembly according to claim 1, wherein the refillable unit is arranged to enable suction to be generated in the storage chamber, at least when the storage chamber is in fluid communication with the receptacle, so as to enable the storage chamber to be filled.

3. An assembly according to claim 1, wherein the receptacle includes an outlet orifice arranged to be placed in fluid communication with the storage chamber of the refillable unit for filling purposes, and wherein the receptacle does not have a pump that feeds said outlet orifice with the liquid.

4. An assembly according to claim 1, wherein a volume of the pump chamber is smaller than a maximum volume of the storage chamber.

5. An assembly according to claim 1,the pump including a suction orifice, wherein, when the refillable unit is placed on the receptacle, said suction orifice of the pump is placed close to an outlet orifice of the receptacle, vertically in registration with said outlet orifice.

6. An assembly according to claim 1, wherein the pump comprises an airless pump.

7. An assembly according to claim 1, wherein the receptacle includes a support arranged to receive the refillable unit, said support being stationary relative to a remainder of the receptacle.

8. An assembly according to claim 1, wherein the refillable unit and the receptacle include respective fastener portions that co-operate in a releasable manner.

9. An assembly according to claim 1, wherein at least one of the refillable unit and the receptacle includes portions in relief that co-operate with the other one of the refillable unit and the receptacle to isolate a suction orifice of the pump in a leaktight manner from outside at least when the refillable unit is used to take the liquid from the receptacle.

10. An assembly according to claim 1, wherein the receptacle does not include an air intake.

11. An assembly according to claim 1, wherein, when the refillable unit is placed on the receptacle with the pump arranged to take the liquid from the receptacle as volume of the storage chamber is at a minimum.

12. An assembly according to claim 1, wherein the piston includes an orifice that puts the receptacle into fluid communication with the storage chamber.

13. An assembly according to claim 12, wherein the refillable unit includes a check valve that is movable between a first position in which the check valve closes said orifice of the piston, and a second position in which the check valve allows the liquid to flow through said orifice.

14. An assembly according to claim 13, wherein the check valve comprises a body with an inside passage.

15. An assembly according to claim 13, wherein the check valve comprises a ball, and wherein the refillable unit includes a resilient return member arranged to apply a force on the ball, tending to return the ball into the closed first position.

16. An assembly according to claim 1, wherein the piston has a shape that substantially matches an outside shape of the pump.

17. An assembly according to claim 1, wherein the piston includes a fastener portion that co-operates in a releasable manner with a fastener portion of the receptacle when the refillable unit is placed on the receptacle.

18. An assembly according to claim 17, wherein the piston includes a skirt that defines a passage in communication with an orifice of the piston, the skirt including the fastener portion.

19. An assembly according to claim 17, wherein the piston includes substantially coaxial inner and outer skirts, the fastener portion being provided on the outer skirt.

20. An assembly according to claim 1, wherein the receptacle includes a central portion that engages in the body of the refillable unit when said refillable unit is placed on the receptacle, said central portion including a fastener portion that co-operates with a fastener portion of the piston.

21. An assembly according to claim 20, wherein the central portion is fastened to a dip tube at least when said refillable unit is placed on the receptacle.

22. An assembly according to claim 1, wherein the receptacle contains a cosmetic, including a care product, and in particular a perfume.

23. An assembly according to claim 22, wherein the liquid comprises a cream.

24. An assembly according to claim 8, wherein the respective fastener portions co-operate by at least one of snap-fastening and screw-fastening.

25. An assembly according to claim 11, wherein, when the refillable unit is placed on the receptacle with the pump arranged to take the liquid from the receptacle, the pump communicates with a dip tube of the receptacle.

26. A refillable unit arranged to be placed in a separable manner on a receptacle, the refillable unit comprising:

a body and a piston that is movable relative to the body and that co-operates therewith to define a storage chamber of variable volume, the storage chamber being put into fluid communication with the receptacle to be filled therefrom when the refillable unit is placed on the receptacle; and a pump arranged to take liquid from the receptacle without taking liquid from the storage chamber when the refillable unit is placed on the receptacle, and to take the liquid from the storage chamber when the refillable unit is separate from the receptacle, the pump including a pump chamber that is distinct from the storage chamber, wherein the storage chamber is formed above the piston when the refillable unit is observed in a head-up position and the pump chamber is isolated from the storage chamber, at least while the pump is dispensing the liquid.

27. A refillable unit according to claim 26, the unit being arranged to enable suction to be generated in the storage chamber, at least when the storage chamber is in fluid communication with the receptacle, so as to enable the storage chamber to be filled under an effect of the suction.

28. A refillable unit according to claim 26, wherein a volume of the pump chamber is smaller than a maximum volume of the storage chamber.

29. A refillable unit according to claim 26, wherein the piston includes an orifice that puts the receptacle into fluid communication with the storage chamber.

30. A method of dispensing liquid, comprising:

providing a packaging and dispenser assembly, that comprises:

the receptacle for containing a supply of the liquid; and the refillable unit according to claim 26;

using the refillable unit to take one of the liquid from the receptacle without taking the liquid from the storage chamber when the refillable unit is placed on the receptacle and the liquid from the storage chamber of the refillable unit when the refillable unit is separate from the receptacle; and dispensing a quantity of the liquid taken by the refillable unit by actuating the pump over a full stroke, a quantity of the liquid dispensed corresponding to a fraction only of a maximum volume of the storage chamber.

31. A method according to claim 30, in which the pump includes a suction orifice and the receptacle includes an outlet orifice, the method further comprising:

putting the suction orifice into communication with the outlet orifice; and taking the liquid from the receptacle.

32. A method according to claim 31, the method further comprising:

placing the refillable unit on the receptacle; and moving the piston relative to the body to increase the volume of the storage chamber, the piston moving away from the pump during such movement.

33. A method according to claim 30, wherein dispensing the quantity of the liquid comprises dispensing less than one-tenth of the maximum volume of the storage chamber by actuating the pump over the full stroke.

* * * * *